United States Patent [19]

Hill

[11] 4,078,248

[45] Mar. 7, 1978

[54] LOCK LIGHT

[76] Inventor: Daniel Hill, P.O. Box 185, Bloomington, Ind. 47401

[21] Appl. No.: 721,338

[22] Filed: Sep. 8, 1976

[51] Int. Cl.[2] ..... E05B 17/10

[52] U.S. Cl. ..... 362/100

[58] Field of Search ..... 240/2.13, 1 EL, 1 LP, 240/151; 362/100

[56] References Cited

U.S. PATENT DOCUMENTS

| | | | |
|---|---|---|---|
| 2,226,854 | 12/1940 | Gohn | 240/2.13 |
| 2,242,626 | 5/1941 | Silker | 240/2.13 |
| 2,701,297 | 2/1955 | Thibault | 240/2.13 |
| 2,709,745 | 5/1955 | Sundt | 240/2.13 |
| 2,767,303 | 10/1956 | Rommey et al. | 240/2.13 |
| 2,831,959 | 4/1958 | Jefferson | 240/2.13 |
| 3,719,821 | 3/1973 | Foreman | 240/2.13 |
| 3,887,803 | 6/1975 | Savage | 240/151 |
| 3,955,075 | 5/1976 | Susedik | 240/2.13 |
| 3,958,113 | 5/1976 | Termohlen | 240/1 EL |

*Primary Examiner*—Donald A. Griffin

*Attorney, Agent, or Firm*—Stevens, Davis, Miller & Mosher

[57] ABSTRACT

Keyhole illumination for a tumbler and cylinder lock comprising a miniature light source and a light transmitting pin in the pin holes.

10 Claims, 2 Drawing Figures

LOCK LIGHT

BACKGROUND OF THE INVENTION

1. Field of the Invention

This invention relates to security devices and, in particular, to locks. It pertains to illumination for locks and especially to the illumination of keyholes.

2. Description of the Prior Art

It has been assumed that human beings have been using locks for several thousand years. Once keys were invented, the need for illumination for finding the keyhole in the dark became evident. Use of a pitch dipped club as a torch to illuminate the keyhole area was clumsy or worse.

Electricity has been in use for illumination for just about a century. Built in electric lights for the illumination of locks, locking areas, and of keyholes has been proposed for some years as, for example, by Sundt in U.S. Pat. No. 2,709,745 issued May 31, 1955; by Rommey, et al. in U.S. Pat. No. 2,767,303, by Jefferson in U.S. Pat. No. 2,831,959, and by Foreman in U.S. Pat. No. 3,719,821. Most of the prior art is for general electric illumination of the entire lock area, or of the area under a doorknob. To date, there have been few disclosures of illumination for keyholes, and such have been complex and expensive and generally not suited for modification of existing locks.

SUMMARY OF THE INVENTION

It is therefore an object of this invention to overcome the limitations and disadvantages in the locks and illumination devices in the prior art and currently available in the market.

One of the objects of the invention is to provide a lock illumination device embodying improved principles of design and construction.

An important object of the invention is to provide a lock illumination device which is comprised of a minimum number of simple durable parts or components which can be economically manufactured and readily assembled.

A significant object of the invention is to provide a lock illumination device, so designed and constructed that it can be readily applied to almost any typical cylinder tumbler lock now in use.

Another object of the invention is to provide a compact low cost installation for conventional tumbler type cylinder locks which can be added to extant locks by do-it-yourselfers.

A further object of the invention is to provide a light for a lock which uses very little electricity, such that a battery can power it for a relatively long time.

A lock light, according to the principles of this invention, provided as an attachment for a conventional cylinder type tumbler lock, comprises a light source which may be a light emitting device, and a light transmitting pin inserted into cylinder and tumbler pin holes to provide illumination to the keyhole of the tumbler.

Further objects and advantages of this invention will appear more clearly from the following description of a nonlimiting illustrative embodiment and the accompanying drawings in which like numerals designate like parts throughout the several views.

DESCRIPTION OF THE DRAWINGS

Briefly summarized, a preferred embodiment of the invention is described in conjunction with an illustrative disclosure thereof in the accompanying drawings, in which.

DESCRIPTION OF TYPICAL EMBODIMENT

Figure 1:
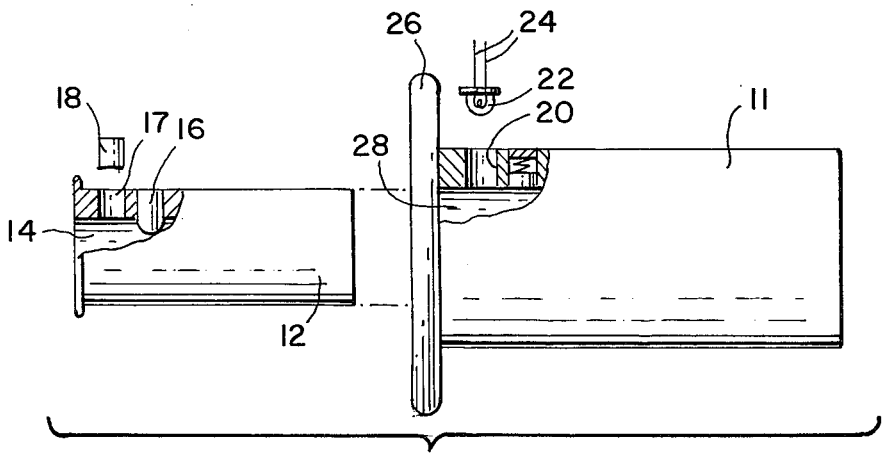
FIG. 1 is an exploded side view representation of a cylinder lock provided with a light for illuminating the keyhole, according to the principles of this invention.
Figure 2:
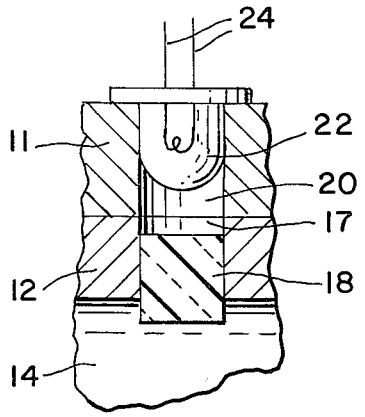
FIG. 2 is a partial sectional view of the assembled cylinder lock showing the light in operating position.

In the drawings a lock having a keyhole 14 light 22 embodying features of the invention is illustrated.

A typical rim 26 lock is shown having a cylinder unit 11 with pin holes 20; into the cylinder main hole 28 a tumbler unit 12 is inserted having pin holes 17 which connect to a central keyhole 14.

In the conventional unit, the holes 17, 20 are filled with pins 16, back up springs, etc.

In this improved lock unit, pin 16 and spring back ups are removed, and the pin hole 17, 20 is filled with a light transmitting pin 18 and a light source 22; the light source 22 in the outer hole 20 shining through the light transmitting pin 18 in the inner hole 17 and the light rays passing into the keyhole 14.

The light source 22 may be a lamp, a light emitting diode, or a fiber optic light pipe to a remote light source. The lamp or diode 22 may be connected to an electrical energy source such as an electrical storage battery by conventional electrical conductors 24 which may include an electric switch for disconnecting the lamp from the energy source to save energy.

The light transmitting pin may be clear or colored and may be made of suitable known materials including methyl methacrylate or glass. The lamp or L.E.D. may similarly be colored as desired.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. In a conventional cylinder type lock provided with a keyhole having a cylinder unit, a cylinder tumbler and tumbler pins in holes; the improvement comprising a minature light emitting means inserted entirely into a pin hole in the cylinder unit and a solid light transmitting tumbler pin inserted into a said pin hole in the tumbler unit through which the light shines into the keyhole thereby illuminating it.

2. The lock of claim 1 wherein the light source further comprises a light conducting pipe suitably associated with a lamp which may be external to the lock.

3. The lock of claim 1 wherein the light source comprises a lamp.

4. The lock of claim 1 wherein the light source comprises a light emitting diode.

5. The lock of claim 1 further comprising electrical conductors connecting the light source to at least one electrical energy source.

6. The lock of claim 5 wherein the electrical energy source comprises at least one electrical storage battery.

7. The lock of claim 5 further comprising an electrical switch connected between the energy source and the light source.

8. The lock of claim 1 wherein the light transmitting pin comprises a light transmitting material.

9. The lock of claim 8 wherein the light transmitting material comprises methyl methacrylate.

10. The lock of claim 8 wherein the light transmitting material comprises glass.

* * * * *